US010978257B2

(12) United States Patent
Nieh et al.

(10) Patent No.: US 10,978,257 B2
(45) Date of Patent: Apr. 13, 2021

(54) LOCK-OFF ASSEMBLY FOR USE IN LOCKING-OFF A TRIGGER OF AN ELECTRICAL DEVICE

(71) Applicants: Defond Electech Co., Ltd, Guangdong (CN); Defond Components Limited, Hong Kong (HK)

(72) Inventors: Cheng Chen Nieh, Hong Kong (HK); Kin Yu Wong, Hong Kong (HK); Lap Yi Law, Hong Kong (HK)

(73) Assignees: DEFOND COMPONENTS LIMITED, Hong Kong (CN); DEFOND ELECTECH CO., LTD, Dongguan (CN)

( * ) Notice: Subject to any disclaimer, the term of this patent is extended or adjusted under 35 U.S.C. 154(b) by 0 days.

(21) Appl. No.: 16/923,562

(22) Filed: Jul. 8, 2020

(65) Prior Publication Data

US 2021/0012980 A1 Jan. 14, 2021

(30) Foreign Application Priority Data

Jul. 9, 2019 (HK) ..... 19126545.3

(51) Int. Cl.
*H01H 9/20* (2006.01)
*H01H 21/22* (2006.01)
*H01H 21/36* (2006.01)

(52) U.S. Cl.
CPC ..... *H01H 9/20* (2013.01); *H01H 21/22* (2013.01); *H01H 21/36* (2013.01)

(58) Field of Classification Search
CPC ..... H01H 9/20; H01H 21/22; H01H 21/36
(Continued)

(56) References Cited

U.S. PATENT DOCUMENTS

2005/0205406 A1* 9/2005 Wong ..... H01H 9/06 200/522
2016/0053517 A1 2/2016 Tomaszewski
2019/0198270 A1* 6/2019 Wong ..... H01H 9/06

FOREIGN PATENT DOCUMENTS

CN 105386663 A 3/2016
CN 105810521 A 7/2016
(Continued)

OTHER PUBLICATIONS

European Search Report, dated Nov. 26, 2020, European Application No. 20184593.0-1202, 5 pages.

*Primary Examiner* — Edwin A. Leon
*Assistant Examiner* — Iman Malakooti
(74) *Attorney, Agent, or Firm* — Seed Intellectual Property Law Group LLP

(57) ABSTRACT

A trigger assembly for an electrical device that includes a main body having a housing within which an electrical switch unit is disposed. The trigger assembly may include a trigger member having an engagement portion that is hingedly connected to the main body so that the trigger member is rotatable about a hinge relative to the main body. The trigger assembly may include an actuator member operably-connected to the trigger member that is movable between an OFF position and an ON position. The trigger assembly may include a lock-off mechanism including a lock-off member that is selectively operable to restrict movement of the trigger member towards the main body and to thereby restrict movement of the actuator member from the OFF position into the ON position, and, to not restrict movement of the trigger member toward the main body.

4 Claims, 4 Drawing Sheets

(58) Field of Classification Search
USPC ..... 200/43.11
See application file for complete search history.

(56) References Cited

FOREIGN PATENT DOCUMENTS

| | | | |
|---|---|---|---|
| CN | 207587633 | U | 7/2018 |
| CN | 108878227 | A | 11/2018 |
| DE | 10 2006 000 316 | A1 | 1/2008 |
| DE | 202018004370 | U1 | 10/2018 |
| EP | 2 101 340 | A1 | 9/2009 |
| EP | 3 503 145 | A1 | 6/2019 |

* cited by examiner

LOCK-OFF ASSEMBLY FOR USE IN LOCKING-OFF A TRIGGER OF AN ELECTRICAL DEVICE

TECHNICAL FIELD

The present invention relates to lock-off mechanisms for triggers of electrical devices such as power tools, gardening tools and the like for locking-off the trigger from operation.

BACKGROUND OF THE INVENTION

Electric power tools will often include a trigger member that is squeezed towards a main body of the tool to actuate operation of the tool motor. The tool will also typically include a lock-off mechanism which is a safety mechanism that can be operated to prevent the trigger member from being inadvertently squeezed and the electric device being turned on. With certain lock-off mechanism designs, the lock-off member is rotatably mounted on to the trigger member and is dependent on the trigger device to function properly. Hence if the trigger member is damaged, for instance due to heat stress deformation, operation of the lock-off mechanism may also be compromised so as to pose a risk of harm to the user. Further, the components of existing lock-off mechanisms often tend to be readily exposed to the environment and are thus subject to degradation and wear and tear which may not only cause the lock-off mechanism to fail but is also unsightly to the user.

SUMMARY OF THE INVENTION

The present invention seeks to alleviate at least one of the above-described problems.

The present invention may involve several broad forms. Embodiments of the present invention may include one or any combination of the different broad forms herein described.

In one broad form, the present invention provides a trigger assembly for use with an electrical device, said trigger assembly including;

a main body having an electric switch housing within which an electrical switch unit is disposed therein;

a trigger member having an engagement portion that is hingedly connected to the main body of the trigger assembly so that the trigger member is rotatable about a hinge relative to the main body, said trigger member also including a first wall and sidewalls defining a trigger member space therebetween;

an actuator member operably-connected to the trigger member wherein, responsive to rotational movement of the trigger member about the hinge relative to the housing, said actuator member is movable in a first direction relative to the housing from an OFF position in which an electrical switch of the electrical device is operably-opened by the actuator towards an ON position in which the electrical switch is operably-closed by the actuator, and is movable in a second direction relative to the housing from the ON position towards the OFF position; and a lock-off mechanism including a lock-off member that is selectably operable to restrict movement of the trigger member towards the main body and to thereby restrict movement of the actuator member from the OFF position into the ON position, and, to not restrict movement of the trigger member toward the main body and to thereby allow movement of the actuator from the OFF position in to the ON position;

wherein the main body includes at least one rigid arm having a first end connected with a surface of the main body and extending away from the main body into the trigger member space terminating at a second end that is spaced apart from the first end, and wherein, said lock-off member is rotatably mounted proximate to the second end of the at least one rigid arm; and wherein the trigger member includes an aperture disposed therein and is configured so that a user may rotatably operate the lock-off member about the second end of the arm via the aperture in the trigger member.

Preferably, the aperture is configured so that when the lock-off member is operated to restrict movement of the trigger member towards the main body, a portion of the lock-off member is configured to protrude outwardly through the aperture.

Preferably, the present invention include a pair of rigid arms extending outwardly from the main body, and wherein the lock-off member rotates about a hinge pin that is rotatably mounted between respective second ends of each of the pair of rigid arms.

Preferably, the present invention includes a biasing element operably-connected between the lock-off member and a surface of the main body of the trigger assembly so as to bias the lock-off member into the position in which it does not restrict movement of the trigger member toward the main body. Also, preferably, the biasing element includes a return spring.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Figure 1:
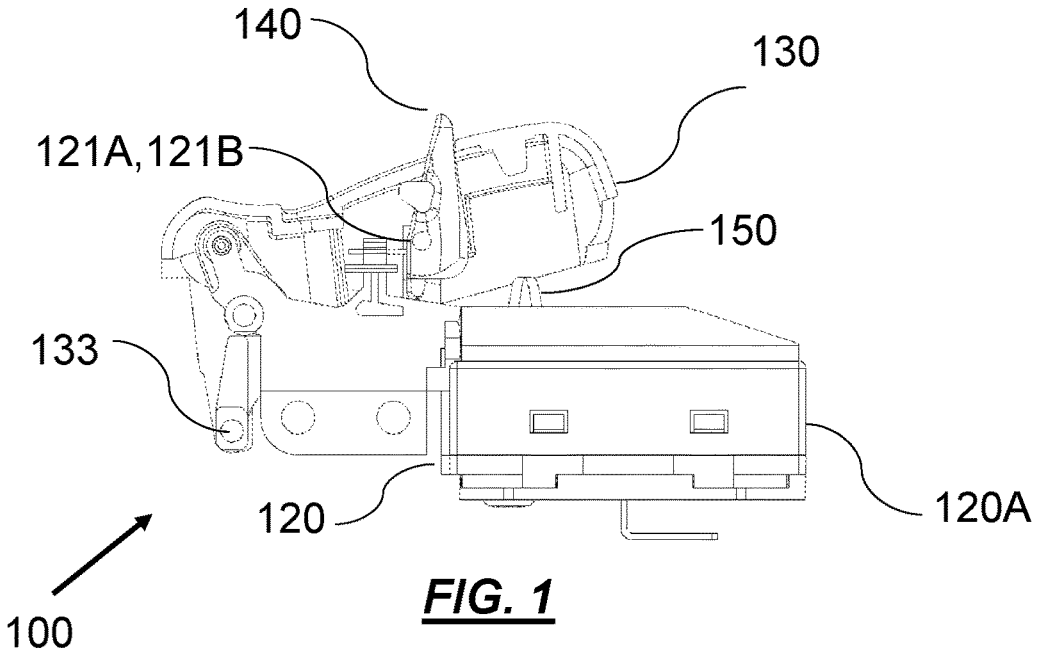
FIG. 1 shows a side partial transparent view of a trigger assembly of a power tool with a lock-off member arranged in a locked-off configuration wherein the trigger member is unable to be squeezed towards the main body of the trigger assembly to actuate the power tool, in accordance with an embodiment of the present invention.
Figure 2:
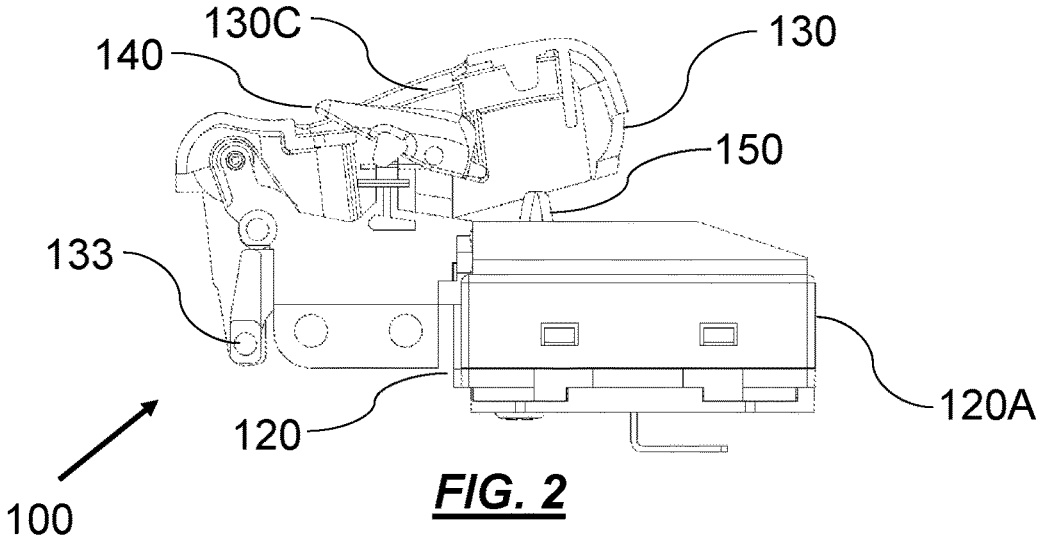
FIG. 2 shows a side partial transparent view of the trigger assembly of the power tool with the lock-off member in the process of being rotated in to a non-locked off configuration in accordance with an embodiment of the present invention.

Preferred embodiments of the present invention will now be described herein with reference to FIGS. 1 to 6. The embodiments comprise a variable-speed trigger assembly (100) for use with an electric power tool having an electric motor including for instance an electric drill, grinder, sander, saw, rotary driving tool and the like. More particularly, the embodiments described herein comprise variable-speed trigger assemblies having a locking-off mechanism to prevent the trigger from being squeezed to actuate operation of the power tool. It would be appreciated and understood that whilst this embodiment is described for use with an electric power tool, this is merely for purposes of illustrating functionality and alternate embodiments of the present invention may of course be used with other types of electric devices such as gardening tools.

The variable-speed trigger assembly (100) includes a hand-operable trigger member (130) that is rotatably movable about a hinge (133) relative to a main body (120) of the trigger assembly (100). The trigger member (130) includes a first wall (130A) and sidewalls (130B) defining a trigger member space (130D) therebetween. An aperture (130C) is disposed in the first wall (130A) of the trigger member (130) as shown in FIGS. 1 to 6. The main body (120) of the trigger assembly (100) includes an electrical switch housing (120A). A return spring biases the trigger member (130) so that it is urged in a direction away from the main body (120). The electrical switch housing (120A) is molded from a rigid plastic material and is mounted on the main body (120) of the electric power tool which in turn is mounted near to a handle of the electric power tool. The housing (120A) encloses an electrical switch unit (not shown) comprising movable and stationary electrical switching contacts that are arranged in series in an electrical circuit between a brushless DC motor and a DC power source (e.g. a battery pack) of the electric power tool.

The trigger member (130) is also operably-connected to an actuator member (150) whereby, when the trigger member (130) is squeezed towards the main body (120), the actuator member (150) is configured to move in a direction inwardly of the housing (120A) from an OFF position towards an ON position. When the user's hand releases the trigger member (130), the return spring urges the trigger member (130) in a direction away from the main body (120), and consequently, the actuator member (150) is also caused to move in a direction outwardly of the housing (120A) from the ON position toward the OFF position. The actuator member (150) is operably-connected to the electrical switching contacts such that in response to the actuator member (150) being moved in to the ON position, the electrical switching contacts are moved in to a closed-circuit arrangement whereby power from the DC power source can be supplied to the brushless DC motor via the pair of electrical switching contacts. Conversely, in response to the actuator member (150) being moved back in to the OFF position by movement of the trigger member (130) away from the main body (120), the pair of electrical switching contacts are moved in to an opened-circuit configuration whereby the DC power source is not able to supply power to the brushless DC motor via the pair of electrical switching contacts. The actuator member (150) is also movable through a range of ON positions inwardly of the housing (120A) depending upon the amount of squeezing force applied to the trigger member (130) by the user's hand and the DC motor is configured to operate at variable speeds of operation depending upon the degree of movement of the actuator member (150) inwardly of the housing.

Figure 3:
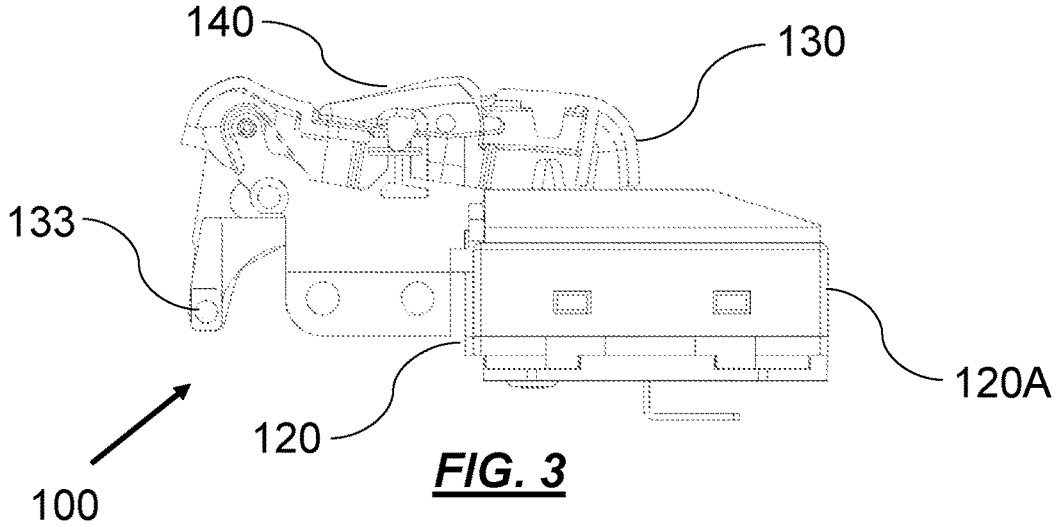
FIG. 3 shows a side partial transparent view of the trigger assembly of the power tool with the lock-off member now fully rotated in to the non-locked off configuration and wherein the trigger member is shown now being able to be squeezed towards the main body of the trigger assembly to actuate operation of the power tool, in accordance with an embodiment of the present invention.
Figure 4:
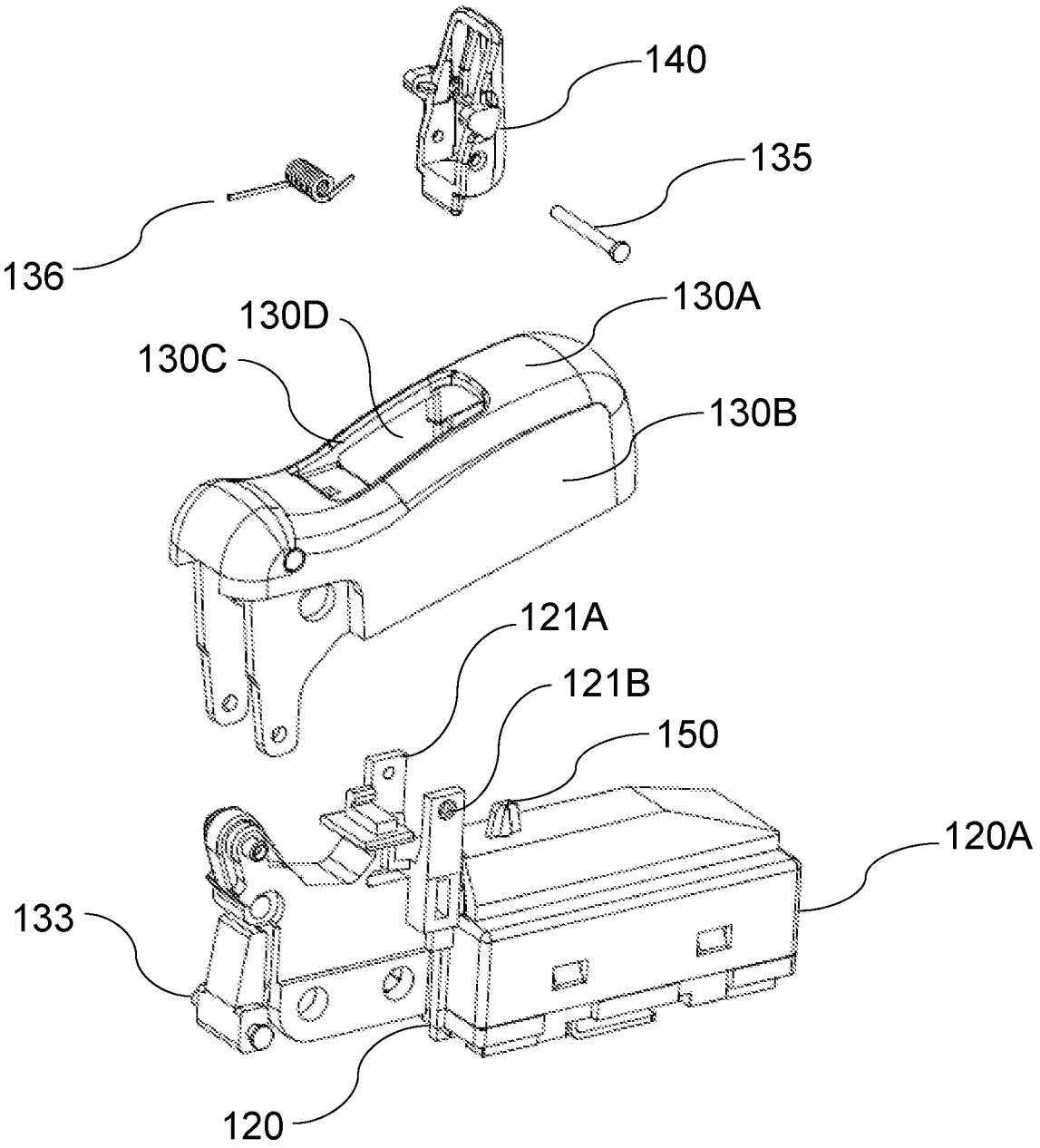
FIG. 4 shows a perspective exploded-view of the trigger assembly of the power tool embodiment of the side view of the trigger assembly of the power tool with the lock-off member now fully rotated in to the non-locked off configuration and wherein the trigger member is shown now being able to be squeezed towards the main body of the trigger assembly to actuate operation of the power tool, in accordance with an embodiment of the present invention.
Figure 5:
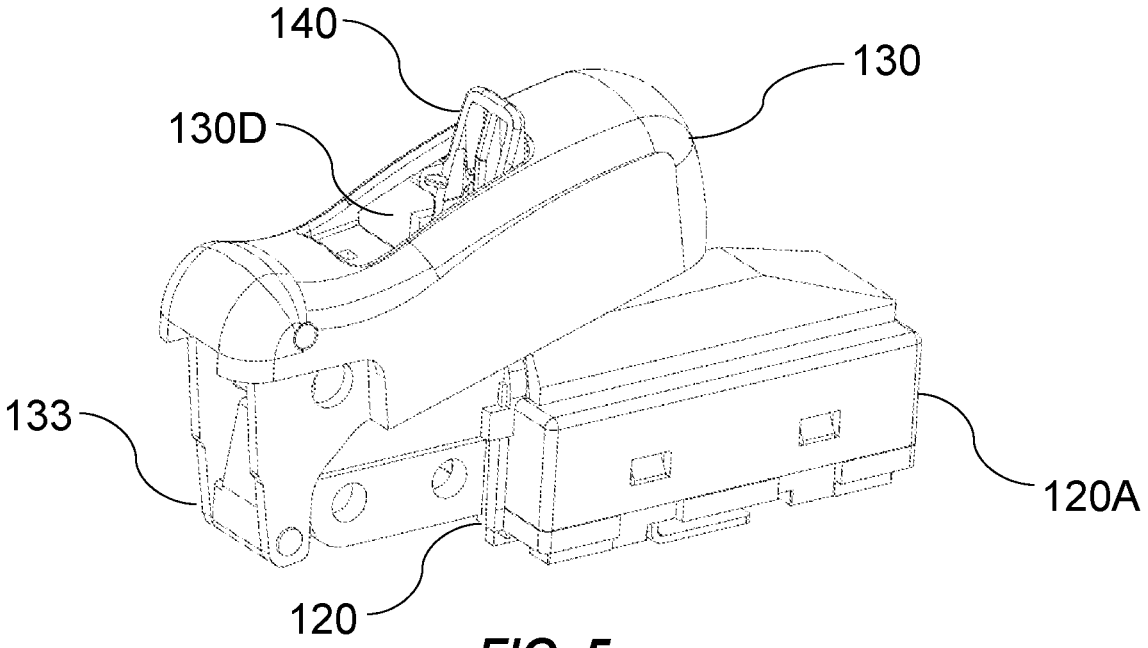
FIG. 5 shows a perspective view of the trigger assembly of the power tool of FIG. 1 with the lock-off member arranged in the locked-off configuration wherein the trigger member is unable to be squeezed towards the main body of the trigger assembly to actuate the power tool, in accordance with an embodiment of the present invention.
Figure 6:
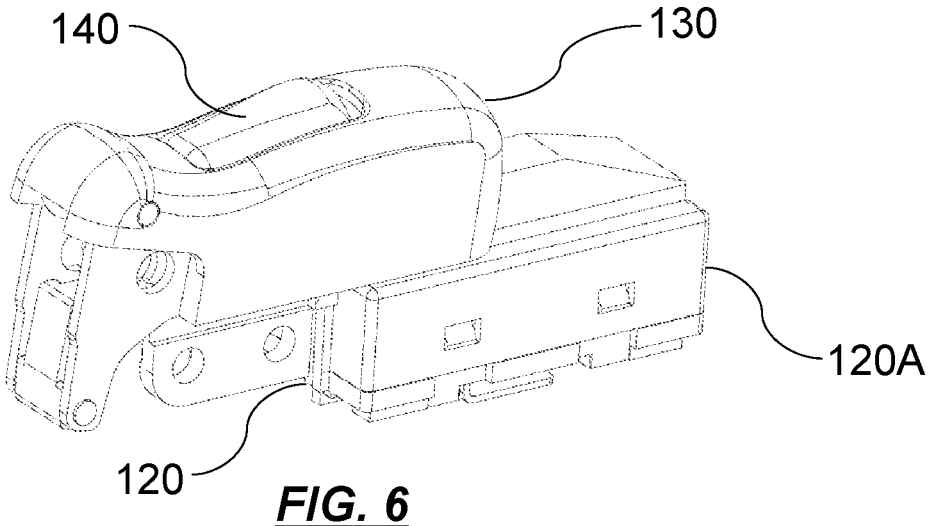
FIG. 6 shows a perspective view of the trigger assembly of the power tool with the lock-off member now fully rotated in to the non-locked off configuration and wherein the trigger member is shown now being able to be squeezed towards the main body of the trigger assembly to actuate operation of the power tool, in accordance with an embodiment of the present invention.

A lock-off mechanism is provided which includes a lock-off member (140) that is selectably operable to restrict movement of the trigger member (130) towards the main body (120) and to thereby restrict movement of the actuator member (150) from the OFF position into the ON position, and, to not restrict movement of the trigger member (130) toward the main body (120) and to thereby allow movement of the actuator (150) from the OFF position in to the ON position. In this embodiment the main body (120) includes a pair of rigid arms (121A,121B)) each having first ends connected with a surface of the main body (120) and extending away from the main body (120) into the trigger member space (130D) terminating at respective second ends that are spaced apart from the first ends of the rigid arms (121A,121B). The lock-off member (140) is rotatably mounted about a hinge pin (135) that extends between the second ends of the rigid arms (121A,121B). A return spring (136) is operably-connected between the lock-off member (140) and a surface of the main body (120) so as to bias the lock-off member (140) into the position in which it does not restrict movement of the trigger member (130) toward the main body (120). The lock-off member (140) and aperture (130C) in the trigger member (130) are suitably configured so that a user may rotatably operate the lock-off member (140) about the second end of the arm via the aperture (130C) in the trigger member (130). When the lock-off member (140) is rotatably arranged to restrict movement of the trigger member (130) towards the main body (120) such as shown in FIGS. 1 and 5, a portion of the lock-off member (140) is configured to protrude outwardly through the aperture (130C). When the lock-off member (140) is rotatably arranged to not restrict movement of the trigger member (130) towards the main body (120) such as shown in FIGS. 3 and 6, an outer surfaces of the lock-off member (140) is configured to substantially cover the aperture (130C) of the trigger member (130) as shown in FIGS. 3 and 6.

Figure 7:
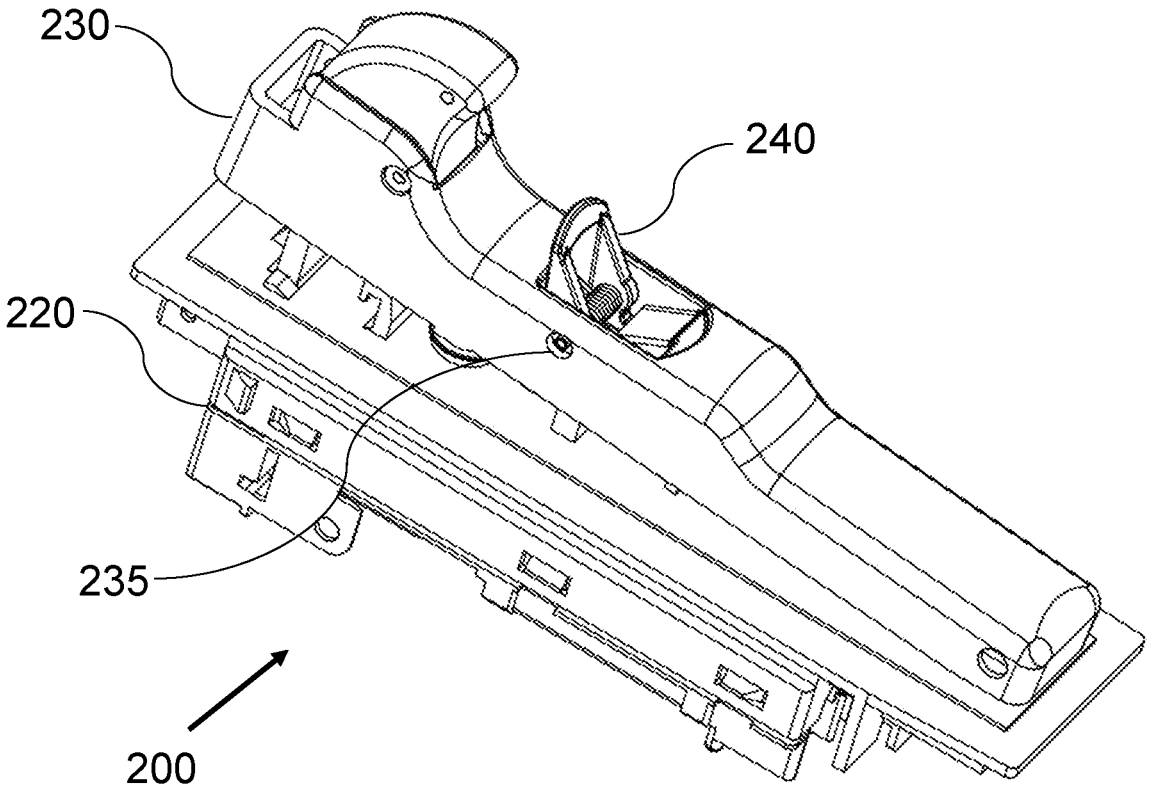
FIG. 7 shows a perspective view of a conventional trigger assembly of a power tool with the lock-off member rotatably mounted to the trigger member of the trigger assembly.

Advantageously as the lock-off assembly is mounted to the main body (120) of the trigger assembly and not to the trigger member (130), it operates independently of the trigger member (130). As such, in the event of damage or failure in the trigger member (130), for instance, due to heat stress deformation, the lock-off (140) assembly will continue to operate effectively to ensure that the electrical device cannot be switched on when locked-off. In contrast, in certain conventional trigger assemblies (200) of power tools, for instance such as shown in FIG. 7, the lock-off member (240) is rotatably mounted about a hinge pin (235) directly on the trigger member (230) and not on the main body (220). Consequently, in such conventional trigger assemblies (200), in the event that the trigger member (230) is damaged, operation of the lock-off assembly (240) is also be compromised such that the user is placed at risk of harm due to the potential for inadvertent actuation of the power tool by operation of the damaged trigger (230). Further, as the hinge pin (135) about which the lock-off member is rotatably mounted to the rigid arms (121A,121B) on the main body and the return spring (136), are concealed within the trigger member space (130D), this alleviates exposure of the hinge pin (135) and return spring (136) to dust, moisture and other particulates in the environment which may cause damage or degradation of these lock-off assembly components. Hence, the usable life of the trigger assembly may be extended compared to existing trigger assemblies in which the hinge pin of the lock-off member may be relatively exposed to the surrounding environment. Yet further, in contrast to conventional trigger assemblies (200) such as depicted in FIG. 7, as the hinge pin of the lock-off member is mounted to the main body of the trigger assembly and concealed within the trigger member space (130D), this additionally provides a more aesthetically pleasing appearance to the trigger assembly.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A trigger assembly for use with an electrical device, said trigger assembly including;

a main body having an electric switch housing within which an electrical switch unit is disposed therein, a trigger member having an engagement portion that is hingedly connected to the main body of the trigger assembly so that the trigger member is rotatable about a hinge relative to the main body, said trigger member also including a first wall and sidewalls defining a trigger member space therebetween;

an actuator member operably-connected to the trigger member wherein, responsive to rotational movement of the trigger member about the hinge relative to the housing, said actuator member is movable in a first direction relative to the housing from an OFF position in which an electrical switch of the electrical device is operably-opened by the actuator member towards an ON position in which the electrical switch is operably-closed by the actuator, and is movable in a second direction relative to the housing from the ON position towards the OFF position; and a lock-off mechanism including a lock-off member that is selectably operable to restrict movement of the trigger member towards the main body and to thereby restrict movement of the actuator member from the OFF position into the ON position, and, to not restrict movement of the trigger member toward the main body and to thereby allow movement of the actuator from the OFF position in to the ON position;

wherein the main body includes at least one rigid arm having a first end connected with a surface of the main body and extending away from the main body into the trigger member space terminating at a second end that is spaced apart from the first end, and wherein, said lock-off member is rotatably mounted proximate to the second end of the at least one rigid arm; and wherein the trigger member includes an aperture disposed therein and is configured so that a user may rotatably operate the lock-off member about the second end of the arm via the aperture in the trigger member.

2. A trigger assembly as claimed in claim 1 wherein the aperture is configured so that when the lock-off member is operated to restrict movement of the trigger member towards the main body, a portion of the lock-off member is configured to protrude outwardly through the aperture.

3. A trigger assembly as claimed in claim 1 including a pair of rigid arms extending outwardly from the main body, and wherein the lock-off member rotates about a hinge pin that is rotatably mounted between respective second ends of each of the pair of rigid arms.

4. A trigger assembly as claimed in claim 1 including a return spring operably-connected between the lock-off member and a surface of the main body of the trigger assembly so as to bias the lock-off member in to the position in which it does not restrict movement of the trigger member toward the main body.

* * * * *